US006458455B1

(12) United States Patent
Hernandez et al.

(10) Patent No.: US 6,458,455 B1
(45) **Date of Patent: *Oct. 1, 2002**

(54) POLY(TRIMETHYLENE TEREPHTHALATE) TETRACHANNEL CROSS-SECTION STAPLE FIBER

(75) Inventors: Ismael A. Hernandez, Clemmons, NC (US); Geoffrey David Hietpas, Newark, DE (US); James M. Howell, Greenville, NC (US); Claudia Schultze, Greenville, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/934,866

(22) Filed: Aug. 22, 2001

Related U.S. Application Data

(60) Provisional application No. 60/231,851, filed on Sep. 12, 2000.

(51) Int. Cl.[7] ..... D01F 6/00

(52) U.S. Cl. ..... 428/359; 428/397; 428/364; 442/357

(58) Field of Search ..... 428/359, 364, 428/395, 397, 400; 442/357

(56) References Cited

U.S. PATENT DOCUMENTS

| | | | |
|---|---|---|---|
| 2,465,319 | A | 3/1949 | Whinfield et al. |
| 3,038,237 | A | 6/1962 | Taylor |
| 3,350,871 | A | 11/1967 | Pierce et al. |
| 3,454,422 | A | 7/1969 | Mead et al. |
| 3,454,460 | A | 7/1969 | Bosley |
| 3,584,103 | A | 6/1971 | Harris |
| 3,671,379 | A | 6/1972 | Evans et al. |
| 3,681,188 | A | 8/1972 | Harris |
| 3,772,137 | A | 11/1973 | Tolliver |

(List continued on next page.)

FOREIGN PATENT DOCUMENTS

| | | |
|---|---|---|
| EP | 745 711 A1 | 12/1996 |
| EP | 1 033 422 A1 | 6/1999 |
| EP | 1 052 325 A1 | 8/1999 |
| EP | 1 016 692 A1 | 5/2000 |
| EP | 1 016 741 A1 | 5/2000 |

(List continued on next page.)

OTHER PUBLICATIONS

International Search Report from counterpart PCT/US01/26681.

"Textile Staple Production", Corterra Polyers, Shell Chemical Company (Copyright Shell 2000).

Ch. Hwo et al., "Opportunities of Corterra PTT fibers in textiles", Reprinted from Chemical Fibers International, vol. 50 (2000) No. 1, Feb. 2000, referencing lecture held at the Polyester 999 World Congress, Oct. 25–28, 1999 in Zurich Switzerland.

(List continued on next page.)

*Primary Examiner*—N. Edwards
(74) *Attorney, Agent, or Firm*—Mark D. Kuller

(57) ABSTRACT

Poly(trimethylene terephthalate) tetrachannel cross-section staple fibers, as well as yarns, fiberfill webs, batts and products, and fabrics made therewith. Also, the process of making such staple fibers, yarns, fiberfill webs, batts and products, and fabrics.

26 Claims, 2 Drawing Sheets

U.S. PATENT DOCUMENTS

| | | | | |
|---|---|---|---|---|
| 3,816,486 | A | | 6/1974 | Vail |
| 3,914,488 | A | | 10/1975 | Gorrafa |
| 3,973,383 | A | | 8/1976 | Yu |
| 3,998,042 | A | | 12/1976 | Reese |
| 4,134,882 | A | | 1/1979 | Frankfort et al. |
| 4,159,617 | A | | 7/1979 | Allan |
| 4,256,589 | A | | 3/1981 | Carver et al. |
| 4,634,625 | A | | 1/1987 | Franklin |
| 4,639,347 | A | | 1/1987 | Hancock et al. |
| 4,710,432 | A | | 12/1987 | Nishimura et al. |
| 4,725,635 | A | | 2/1988 | Okada et al. |
| 4,794,038 | A | | 12/1988 | Marcus |
| 4,836,763 | A | | 6/1989 | Broaddus |
| 4,850,847 | A | | 7/1989 | Samuelson |
| 5,104,725 | A | | 4/1992 | Broaddus |
| 5,112,684 | A | | 5/1992 | Halm et al. |
| 5,458,971 | A | | 10/1995 | Hernandez et al. |
| 5,527,600 | A | | 6/1996 | Frankosky et al. |
| 5,591,523 | A | | 1/1997 | Aneja |
| 5,626,961 | A | | 5/1997 | Aneja |
| 5,645,782 | A | | 7/1997 | Howell et al. |
| 5,683,811 | A | | 11/1997 | Hernandez et al. |
| 5,723,215 | A | | 3/1998 | Hernandez et al. |
| 5,736,243 | A | * | 4/1998 | Aneja ..... 428/397 |
| 5,782,935 | A | | 7/1998 | Hirt et al. |
| 5,817,740 | A | | 10/1998 | Anderson et al. |
| 5,834,119 | A | | 11/1998 | Roop |
| 5,851,665 | A | | 12/1998 | Marcus |
| 5,874,372 | A | | 2/1999 | Morishita et al. |
| 5,882,794 | A | | 3/1999 | Hernandez et al. |
| 5,891,568 | A | | 4/1999 | Hartzog et al. |
| 5,968,647 | A | * | 10/1999 | Aneja ..... 428/397 |
| 5,970,700 | A | | 10/1999 | Scheerer et al. |
| 5,994,451 | A | | 11/1999 | Dangayach |
| 6,023,926 | A | | 2/2000 | Flynn |
| 6,037,057 | A | | 3/2000 | Hartzog et al. |
| 6,250,060 | B1 | | 6/2001 | Scheerer et al. |
| 6,287,688 | B1 | | 9/2001 | Howell et al. |
| 6,306,498 | B1 | | 10/2001 | Yuuki et al. |
| 2001/0030377 | A1 | | 10/2001 | Howell et al. |
| 2001/0030378 | A1 | | 10/2001 | Howell et al. |
| 2001/0031356 | A1 | | 10/2001 | Howell et al. |

FOREIGN PATENT DOCUMENTS

| | | | |
|---|---|---|---|
| EP | 1 160 362 | A1 | 12/2001 |
| GB | 1 075 689 | | 7/1967 |
| GB | 1 165 312 | | 9/1969 |
| GB | 1 254 826 | | 11/1971 |
| JP | 52-5320 | | 1/1977 |
| JP | 58-076517 | | 9/1983 |
| JP | 62-85026 | | 4/1987 |
| JP | 02-61111 | | 3/1990 |
| JP | 05-71013 | | 3/1993 |
| JP | 9-111629 | | 4/1997 |
| JP | 11-093034 | | 4/1999 |
| JP | 11-100721 | | 4/1999 |
| JP | 11-100768 | | 4/1999 |
| JP | 11-107036 | | 4/1999 |
| JP | 11-107038 | | 4/1999 |
| JP | 11-107081 | | 4/1999 |
| JP | 11-107149 | | 4/1999 |
| JP | 11-158733 | | 6/1999 |
| JP | 11-189920 | | 7/1999 |
| JP | 11-189938 | | 7/1999 |
| JP | 11-335954 | | 12/1999 |
| JP | 00-017556 | A | 1/2000 |
| WO | WO 93-11292 | A1 | 6/1993 |
| WO | WO 99/28122 | | 6/1999 |
| WO | WO 99/50483 | | 10/1999 |
| WO | WO 00/03078 | | 1/2000 |
| WO | WO 00/26301 | | 5/2000 |
| WO | WO 01/07693 | A1 | 2/2001 |
| WO | WO 01-49909 | A1 | 7/2001 |
| WO | WO 01/66837 | A1 | 9/2001 |
| WO | WO 01/66838 | A1 | 9/2001 |
| WO | WO 01/68962 | A2 | 9/2001 |

OTHER PUBLICATIONS

H.S. Brown, et al., "Poly(Trimethylene Terephthalate) Polymers for Fibers", Shell Chemical Company (Copyright 1999).

M. Moerman, et al., Corterra Polymers, Value Proposition in Textile Apparel Applications, Shell Chemical Company (Copyright Shell 2001).

P. Casey et al., "Elastic PTT staple spun yarns and fabrics", Research Disclosure 445034 (May 2001).

P. Casey et al., "Staple fibers made from low intrinsic viscosity polytrimethyleneterephthalate", Research Disclosure 445077 (May 2001).

H.L. Traub, et al., "Mechanical properties of fibers made of polytrimethylene terephthalate", Chemical Fibers International, vol. 45, pp. 110–111 (1995).

I. M. Ward, et al., "The Mechanical Properties and Structure of Poly(m–methylene Terephthalate) Fibers", Journal of Polymer Science vol. 14, 263–274 (1976).

H. L. Traub, "Synthese und textilchemische Eigenschaften des Poly–Trimethyleneterephthalats", Dissertation Universitat Stuttgart (1994), (Translation).

S. Schauhoff, "New Developments in the Production of Polytrimethylene Terephthalate (PTT)", Man–Made Fiber Year Book (Sep. 1996).

"Corterra® staple fibre for spinning", from Shell Chemical Compani for presentation at 39th International Man–made Fibre Congress, held Dornbirn, Austria (Sep. 13–15, 2000).

U.S. patent application Ser. No. 09/518,732, filed Mar. 3, 2000 (Docket# CH2756).

U.S. patent application Ser. No. 09/795,933, filed Feb. 28, 2001 (Docket# CH2756 DIV).

U.S. patent application Ser. No. 09/518,759, filled Mar. 3, 2000 (Docket# DP6535).

U.S. patent application Ser. No. 09/795,518, filed Feb. 28, 2001 (Docket# DP6535 CIP).

U.S. patent application Ser. No. 09/795,520, filed Feb. 28, 2001 (Docket# DP6535 CIP1).

U.S. patent application Ser. No. 60/187,244, filed Mar. 3, 2000 (Docket# DP6540 P1).

U.S. patent application Ser. No. 09/796,785, filled Mar. 1, 2001 (Docket# DP6540).

U.S. patent application Ser. No. 09/855,343 filed May 15, 2001 (Docket# DP6760).

U.S. patent application Ser. No. 09/863,166, filed May 23, 2001 (Docket# DP6800).

Research Disclosure 17410 (Oct. 1978).
U.S. patent application Ser. No. 09/934,904, filed Aug. 22, 2001 (Docket# DP6670).
U.S. patent application Ser. No. 09/934,905, filed Aug. 22, 2001 (Docket# DP6675).
C. C. Hwo, et al., Nonwovens from Poly(trimethylene terephthalate) Staple, Corterra Polymers, (Shell Chemicals 2000).
J. Bettner, et al., "High productivity staple fiber spinning technology", *Man Made Fibers Year Book* (Aug. 2001).
J. Bettner et al., Zimmer AG, "High Productivity of Staple Fiber Production", *The Polyester Chain 2001* (Zurich Dec. 23, 2001).
I. Cordes et al., "New Spinning System, Advanced Staple Line Concept Boost Throughput by 100%", *International Fibers Journal* (1998).

* cited by examiner

POLY(TRIMETHYLENE TEREPHTHALATE) TETRACHANNEL CROSS-SECTION STAPLE FIBER

RELATED APPLICATIONS

This application claims priority from U.S. Provisional Patent Application Ser. No. 60/231,851, filed Sep. 12, 2000, which is incorporated herein by reference.

FIELD OF THE INVENTION

The present invention relates to tetrachannel cross-section staple fibers, as well as yarn, fabrics and fiberfill made therewith and the process of making such staple fibers.

BACKGROUND OF THE INVENTION

Polyethylene terephthalate ("2GT") and polybutylene terephthalate ("4GT"), generally referred to as "polyalkylene terephthalates", are common commercial polyesters. Polyalkylene terephthalates have excellent physical and chemical properties, in particular chemical, heat and light stability, high melting points and high strength. As a result they have been widely used for resins, films and fibers, including staple fibers and fiberfill comprising such staple fibers.

Synthetic fibers made from 2GT are well known in the textile industry. Further, the properties and processing parameters of 2GT polymer are well known. Such synthetic fibers are commonly classified into two groups: (1) continuous filaments and (2) discontinuous fibers, often referred to as "staple" or "cut" fibers. Common end-use products made from 2GT staple fibers include yarn, fabric and fiberfill.

2GT staple fibers are desirable in such end-use products because of certain characteristics. For example, fabric and yarns from staple fibers from 2GT are known to produce yarns having desirable characteristics for downstream processing as disclosed by Aneja in U.S. Pat. No. 5,736,243. For instance, such fibers are suitable for processing on worsted systems. Furthermore, yarns made from such fibers are useful in manufacturing lightweight fabrics having good moisture wicking ability. Moisture wicking is desirable in fabrics used in many types of clothing items, e.g., sporting apparel, because they help keep moisture away from the wearer. Similarly, lightweight fabrics are desirable because they are less cumbersome than heavier fabrics.

Certain 2GT staple fibers are even more desirable in such end-use products because of special shape characteristics. For example, U.S. Pat. No. 5,736,243 discloses fabric and yarns of 2GT staple fibers having a tetrachannel cross-section, more specifically a scalloped-oval cross-section with channels that run along the length of the filament. Yarns made from such fibers are particularly useful in manufacturing lightweight fabric having good moisture wicking ability.

Recently, polytrimethylene terephthalate (3GT), also called polypropylene terephthalate, has achieved growing commercial interest as a fiber because of the recent developments in lower cost routes to 1,3-propane diol (PDO), one of the polymer backbone monomer components. 3GT has long been desirable in fiber form for its disperse dyeability at atmospheric pressure, low bending modulus, elastic recovery and resilience. However, the manufacture of 3GT staple fiber suitable for high-strength, high-elasticity yarns poses a number of special problems, particularly in obtaining satisfactory fiber crimp and yarn strength. The solutions to these problems developed over the years for 2GT or 4GT fibers frequently do not apply to 3GT fibers because of 3GT's unique properties.

U.S. patent application Ser. Nos. 09/795,518 (Attorney Docket: DP6535 US CIP, now U.S. Pat. No. 6,383,632) and 09/795,520, both filed Feb. 28, 2001 (Attorney Docket: DP6535 US CIP1, published as U.S. 2001/0030377 A1), and both of which claim priority from U.S. patent application Ser. No. 09/518,759 filed Mar. 3, 2000, now abandoned (Attorney Docket: DP6535), are directed to 3GT drawn yarn and a process of making the drawn yarn from 3GT partially oriented feed yarn, as well as 3GT fine denier partially oriented undrawn feed yarn and its preparation. The very fine filament yarns are suitable for warp drawing, air jet texturing, false-twist texturing, gear crimping, and stuffer-box crimping, for example. Tows made from these filament may also be crimped, if desired, and cut into staple and flock.

U.S. patent application Ser. No. 09/796,785, filed Mar. 1, 2001 (Attorney Docket: DP6540, published as U.S. 2001/0033929 A1), which claims priority from U.S. Provisional Patent Application Ser. No. 60/187,244, filed Mar. 3, 2000, is directed to 3GT direct-use yarns comprising non-round filaments and a process for spinning such yarn. The non-round cross-section yarns include those cross-sections described in the art as "octa-lobal". "sunburst" (also known as "sol"), "scalloped oval", "tri-lobal", "tetra-channel" (also known as "quatra-channel"), "scalloped ribbon", "ribbon", "starburst", etc." Example II is directed to preparing a direct-use yam having filaments of varying cross-sections. Half of the resulting filaments had an octalobal cross-section and half had a sunburst cross-section. Example III is directed to octa-lobal cross-section filaments. FIGS. 2 and 3 are schematic diagrams of hypothetical filaments having an octalobal cross-section. FIG. 5 is a micrograph (750× magnification) of filaments having an octa-lobal cross-section prepared as described in Example III.

U.S. patent application Ser. Nos. 09/518,732, filed Mar. 3, 2000 (issue fee paid) (Attorney Docket: CH2756, now U.S. 6,287,688) and 09/795,933, filed Feb. 28, 2001 (Attorney Docket: CH2756 US DIV, published as U.S. 2001/0030378 A1), are directed to a 3GT partially oriented yarn, a process for spinning a stable 3GT partially oriented yarn, and a process for continuous draw-texturing a 3GT partially oriented yarn. The yarns can have round, oval., octa-lobal, tri-lobal, scalloped oval, and other shapes, with round being most common. Sample IIB (See, Example II, Table 2) is an octa-lobal partially oriented yarn.

JP 11-189938 teaches making 3GT short fibers (3–200 mm), and describes a moist heat treatment step at 100–160° C. for 0.01 to 90 minutes or dry heat treatment step at 100–300° C. for 0.01–20 minutes. In Working Example 1, 3GT is spun at 260° C. with a yarn-spinning take-up speed of 1800 m/minute. After drawing the fiber is given a constant length heat treatment at 150° C. for 5 minutes with a liquid bath. Then it is crimped and cut. Working Example 2 applies a dry heat treatment at 200° C. for 3 minutes to the drawn fibers.

JP 11-107081 describes relaxation of 3GT multifilament yarn unstretched fiber at a temperature below 150° C., preferably 110–150° C., for 0.2–0.8 seconds, preferably 0.3–0.6 seconds, followed by false twisting the multifilament yarn. This document does not teach a process for making a high tenacity crimped 3GT staple fiber.

U.S. Pat. No. 3,584,103 describes a process for melt spinning 3GT filaments having asymmetric birefringence. Helically crimped textile fibers of 3GT are prepared by melt spinning filaments to have asymmetric birefringence across their diameters, drawing the filaments to orient the molecules thereof, annealing the drawn filaments at 100–190° C. while held at constant length, and heating the annealed filaments in a relaxed condition above 45° C., preferably at about 140° C. for 2–10 minutes, to develop crimp. All of the examples demonstrate relaxing the fibers at 140° C.

EP 1 016 741 describes using a phosphorus additive and certain 3GT polymer quality constraints for obtaining improved whiteness, melt stability and spinning stability. The filaments and short fibers prepared after spinning and drawing are heat treated at 90–200° C., but are not crimped and relaxed. It states (page 8, line 18) that the cross-sectional shape of the fiber is not particularly limited and may be round, trilobal, flat, star-shaped, w-shaped, etc., and either solid or hollow. WO 01/16413, to the same applicant, claims special advantages for a 3GT fiber extruded with a convex-modified trilobal cross-section.

All of the documents described above are incorporated herein by reference in their entirety.

None of the cited documents teach a process for making a tetrachannel 3GT staple fiber, nor teach the special advantages of such a 3GT staple fiber.

SUMMARY OF THE INVENTION

This invention comprises a poly(trimethylene terephthalate) staple fiber having a tetrachannel cross-section. Preferably the tetrachannel cross-section comprises a scalloped-oval shape with grooves.

Preferably the poly(trimethylene terephthalate) fiber has a tenacity of 3 grams/denier (2.65 cN/dtex) or higher. Preferably, poly(trimethylene terephthalate) fiber has a crimp take-up of 10% to 60%.

Preferably the above poly(trimethylene terephthalate) fiber is made by a process comprising the melting of a poly(trimethylene terephthalate) polymer, spinning the melt at a temperature of 245° C. to 285° C., quenching the fibers, drawing the fibers, crimping the fibers using a mechanical crimper, relaxing the crimped fiber at a temperature of 50° C. to 120° C., and then cutting the fibers to a length of about 0.2 to 6 inches (about 0.5 to 15 cm).

The staple fibers from the above process have a crimp take-up of 10–60% and a tenacity of at least 3 grams/denier (2.65 cN/dtex).

The invention is also directed to blends of the staple fibers of the invention and cotton, 2GT. nylon, lyocel, acrylic, polybutylene terephthalate (4GT) and other fibers.

The invention is also directed to a yarn made from a poly(trimethylene terephthalate) staple fiber having a tetrachannel cross-section. The invention is further directed to a fabric made from such a yarn. Preferably the fabric has a dye uptake of at least 300%.

The invention is also directed to nonwoven, woven and knitted fabrics made from such fibers and such blends. The invention is further directed to yarns made from such blends, and woven and knitted fabrics made therefrom, as well as fiberfill made from such blends.

The invention is further directed to fibers, yarn and fabric, particularly knitted fabric. with excellent wicking and/or pilling performance. A preferred fabric, preferably a knitted fabric, preferably has a wicking height of at least 2 inches (5 cm) after 5 minutes, preferably at least 4 inches (10 cm) after 10 minutes, preferably at least 5 inches (13 cm) after 30 minutes. The preferred fabrics have fuzzy pills (as opposed to hard pills), which are considered preferable as they result in less pill sensation.

The invention is also directed to the fiberfill webs, batts or products comprising the staple fibers.

The invention is further directed to methods for making the poly(trimethylene terephthalate) yarns, fiberfill webs, batts and products, and fabrics.

DETAILED DESCRIPTION OF THE INVENTION

Polytrimethylene terephthalate useful in this invention may be produced by known manufacturing techniques (batch, continuous, etc.), such as described in U.S. Pat. Nos. 5;015,789, 5,276,201, 5,284,979, 5,334,778, 5,364,984, 5,364,987, 5.391,263, 5,434,239, 5,510454, 5,504,122, 5,532,333, 5,532,404, 5,540,868, 5.633,018, 5,633,362, 5,677,415, 5,686,276, 5,710,315, 5,714,262, 5,730,913, 5.763,104, 5,774,074, 5,786,443, 5,811,496, 5,821,092, 5,830,982, 5,840,957, 5.856,423, 5,962,745, 5,990265, 6,140,543, 6,245,844, 6,277,289, 6,281,325, 6.255,442 and 6,066,714, EP 998 440, WO 01/09073, 01/09069, 01/34693, 00/14041, 00/58393, 01/14450 and 98/57913, H. L. Traub, "Synthese und textilchemische Eigenschaften des Poly-Trimethyleneterephthalats", Dissertation Universitat Stuttgart (1994), S. Schauhoff, "New Developments in the Production of Polytrimethylene Terephthalate (PTT)", Man-Made Fiber Year Book (September 1996), and U.S. patent application Ser. Nos. 09/501,700 (now U.S. 6,353,062 B1), 09/502,322 (now U.S. 6,312,805 B1), 09/502,642 and 09/503,599, all of which are incorporated herein by reference. Polytrimethylene terephthalates useful as the polyester of this invention are commercially available from E. I. du Pont de Nemours and Company, Wilmington, Del. under the trademark "Sorona".

Preferably the fiber (polytrimethylene terephthalate) has a relative viscosity (LRV) of at least 34, and it may be as high as 60 or more.

The polytrimethylene terephthalate suitable for this invention has an intrinsic viscosity of at 0.60 deciliters/gram (dl/g) or higher, preferably at least 0.70 dl/g, more preferably at least 0.80 dl/g and most preferably at least 0.90 dl/g. The intrinsic viscosity is typically about 1.5 dl/g or less, preferably 1.4 dl/g or less, more preferably 1.2 dl/g or less, and most preferably 1.1 dl/g or less. Polytrimethylene terephthalate homopolymers particularly useful in practicing this invention have a melting point of approximately 225–231° C.

Spinning can be carried out using conventional techniques and equipment useful with respect to polyester fibers, with preferred approaches described herein. For instance, various spinning methods are shown in U.S. Pat. Nos. 3,816,486 and 4,639,347, U.S. patent application Ser. No. 09/855,343, filed May 15, 2001 (Docket No. DP6760), British Patent Specification No. 1 254 826 and JP 11-189938, all of which are incorporated herein by reference.

The spinning speed is preferably 600 meters per minute or more, and typically 2500 meters per minute or less. The spinning temperature is typically 245° C. or more and 285° C. or less, preferably 275° C. or less. Most preferably the spinning is carried out at about 255° C.

Figure 1:
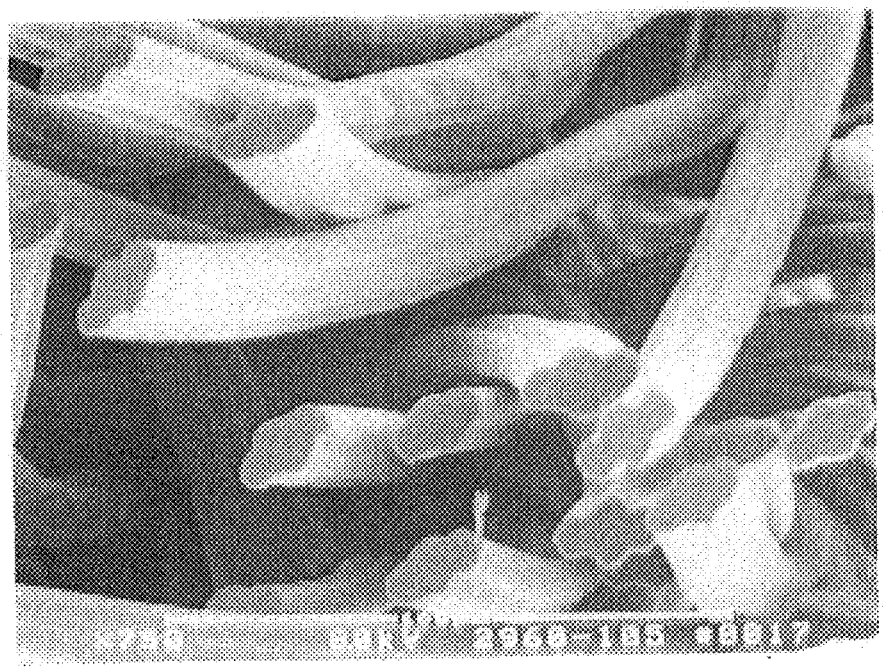
FIG. 1 is a magnified photograph showing the cross-sectional configuration of staple fibers made from poly (trimethylene terephthalate) according to the method of the present invention.

The spinneret is designed to extrude a fiber having a tetrachannel cross-section. The preferred spinneret used is the type described in U.S. Pat. No. 3,914,488 Gorrafa FIG. 1 and U.S. Pat. No. 4,634,625, FIG. 1, both patents being incorporated herein by reference. These spinnerets provide fibers having a tetrachannel cross-section. comprising a scalloped-oval shape with grooves. However, the shape of any extruded fiber may not be identical to the shape of the spinneret because of polymer cohesion and resultant polymer flow after extrusion and before quenching and drawing. This flow may tend to blur the advantages inherent in the original spinneret shape. Surprisingly, the inventors have found that the tetrachannel fibers of 3GT have a much better-defined shape than does 2GT. This feature is shown in this invention's FIGS. 1 through 3 (illustrating 3GT) compared to FIG. 4 (illustrating 2GT). This better-defined shape enhances the advantages shown by a tetrachannel structure.

Quenching can be carried out in a conventional manner, using air or other fluids described in the art (e.g., nitrogen). Cross-flow, radial or other conventional techniques may be used.

Conventional spin finishes are applied after quenching via standard techniques (e.g., using a kiss roll.)

The melt spun filaments are collected on a tow can. Then, several tow cans are placed together and a large tow is formed from the filaments. After this, the filaments are drawn using conventional techniques, preferably at about 50—about 120 yards/minute (about 46—about 110 m/minute). Draw ratios preferably range from about 1.25—about 4, more preferably from 1.25–2.5, and most preferably at least 1.4 and preferably up to 1.6. Drawing is preferably carried out using two-stage drawing (see, e.g., U.S. Pat. No. 3,816,486, incorporated herein by reference).

A finish can be applied during drawing using conventional techniques.

According to one preferred embodiment, the fibers are annealed after drawing and before crimping and relaxing. By "annealing" is meant that the drawn fibers are heated under tension. Annealing is preferably carried out at least about 85° C. and preferably at about 115° C. or less. Most preferably annealing is carried out at about 100° C. Preferably annealing is carried out using heated rollers. It may also be carried out using saturated steam according to U.S. Pat. No. 4,704,329, which is incorporated herein by reference. According to a second option, annealing is not carried out. Preferably, annealing is omitted in making fiberfill.

Conventional mechanical crimping techniques may be used. Preferred is a mechanical staple crimper with a steam assist, such as stuffer box.

A finish can be applied at the crimper using conventional techniques.

Crimp level is typically 8 crimps per inch (cpi)) (3 crimps per cm (cpc) or more, preferably 10 cpi (3.9 cpc) or more, and most preferably 14 cpi (5.5 cpc) or more, and typically 30 cpi (11.8 cpc) or less, preferably 25 cpi (9.8 cpc) or less, and more preferably 20 cpi (7.9 cpc) or less. The resulting crimp take-up is a function of fiber properties, and is preferably 10% or more, more preferably 15% or more, and most preferably 20% or more, and preferably is up to 40%, more preferably upto 60%.

When making fiberfill, a slickener is preferably applied after crimping, but before relaxing. Slickeners useful in preparing fiberfill are described in U.S. Pat. No. 4.725,635, which is incorporated herein by reference.

A lower temperature for the relaxation can be used to obtain maximum crimp take-up. By "relaxation" is meant that the filaments are heated in an unconstrained condition so that the filaments are free to shrink. Relaxation is carried out after crimping and before cutting. Typically relaxation is carried out to take out shrinkage and dry the fibers. In a typical relaxer, fibers rest on a conveyor belt and pass through an oven. The minimum the temperature of the relaxation useful for this invention is 40° C., as lower temperatures will not permit the fiber to dry in a sufficient amount of time. Relaxation is preferably at a temperature of 120° C. or less, more preferably 105° C. or less, even more preferably at 100° C. or less, still more preferably below 100° C., and most preferably below 80° C. Preferably the temperature of the relaxation is 55° C. or above, more preferably above 55° C., more preferably 60° C. or above, and most preferably above 60° C. Preferably the relaxation time does not exceed about 60 minutes, more preferably it is 25 minutes or less. The relaxation time must be long enough to dry the fibers and bring the fibers to the desired relaxation temperature, which is dependant on the size of the tow denier and can be seconds when small quantities (e.g., 1,000 denier (1,100 dtex)) are relaxed. In commercial settings, times can be as short as 1 minute. Preferably the filaments pass through the oven at a rate of 50–200 yards/minute (46—about 183 meters/minute) for 6–20 minutes or at other rates suitable to relax and dry the fibers.

Preferably the filaments are collected in a piddler can, followed by cutting and baling. The staple fibers of this invention are preferably cut by a mechanical cutter following relaxation. Preferably, the fibers are about 0.2—about 6 inches (about 0.5—about 15 cm), more preferably about 0.5—about 3 inches (about 1.3—about 7.6 cm), and most preferably about 1.5 inch (3.8 cm). Different staple length may he preferred for different end uses.

The staple fiber preferably has a tenacity of 3.0 grams/denier (g/d) (2.65 cN/dtex) (Conversions to cN/dtex were carried out using 0.883 multiplied by g/d value, which is the industry standard technique.) or higher, preferably greater than 3.0 g/d (2.65 cN/dtex), to enable processing on high-speed spinning and carding equipment without fiber damage. Staple fibers prepared by drawing and relaxing, but not annealing, have tenacities greater than 3.0 g/d (2.65 cN/dtex), preferably 3.1 g/d (2.74 cN/dtex) or higher. Staple fibers prepared by drawing, relaxing and annealing, have tenacities greater than 3.5 g/d (3.1 cN/dtex), preferably 3.6 g/d (3.2 cN/dtex) or higher, more preferably 3.75 g/d (3.3 cN/dtex) or higher, even more preferably 3.9 g/d (3.44 cN/dtex) or higher, and most preferably 4.0 g/d (3.53 cN/dtex) or higher. Tenacities of up to 6.5 g/d (5.74 cN/dtex) or higher can be prepared by the process of the invention. For some end used, tenacities up to 5 g/d (4.4 cN/dtex), preferably 4.6 g/d (4.1 cN/dtex), are preferred. High tenacities may cause excessive fiber pilling on textile surfaces. Most notably, these tenacities can be achieved with elongations (elongation to break) of 55% or less, and normally 20% or more.

The fibers preferably contain at least 85 weight %, more preferably 90 weight % and even more preferably at least 95 weight % polytrimethylene terephthalate polymer. The most preferred polymers contain substantially all polytrimethylene terephthalate polymer and the additives used in polytrimethylene terephthalate fibers. Such additives include antioxidants, stabilizers (e.g., UV stabilizers). delusterants (e.g., $TiO_2$, zinc sulfide or zinc oxide), pigments (e.g., $TiO_2$, etc.), flame retardants, antistats, dyes, fillers (such as calcium carbonate), antimicrobial agents, antistatic agents, optical brighteners, extenders, processing aids and other compounds that enhance the manufacturing process or performance of polytrimethylene terephthalate. When used, $TiO_2$ is preferably added in an amount of at least about 0.01 weight %, more preferably at least about 0.02 weight %, and preferably up to about 5% weight %, more preferably up to about 3 weight %, and most preferably up to about 2 weight %, by weight of the polymers or fibers. Dull polymers preferably contain about 2 weight % and semi-dull polymers preferably contain about 0.3 weight %.

The fibers prepared according to this invention for apparel (e.g., knitted and woven fabrics) and nonwovens are typically at least 0.8 denier per filament (dpf) (0.88 decitex (dtex)), preferably at least 1 dpf (1.1 dtex), and most preferably at least 1.2 dpf (1.3 dtex). They preferably are 3 dpf (3.3 dtex) or less, more preferably 2.5 dpf (2.8 dtex) or less, and most preferably 2 dpf (2.2 dtex) or less. Most preferred is about 1.4 dpf (about 1.5 dtex). Nonwovens typically utilize about 1.5—about 6 dpf (about 1.65—about 6.6 dtex) staple fibers. Higher denier fibers up to 6 dpf (6.6 dtex) can be used, and even higher deniers are useful for non-textile uses such as fiberfill.

Fiberfill utilizes about 0.8—about 15 dpf (about 0.88—about 16.5 dtex) staple fibers. The fibers prepared for fiberfill are typically at least 3 dpf (3.3 dtex), more preferably at least 6 dpf (6.6 dtex). They typically are 15 dpf (16.5 dtex) or less. more preferably 9 dpf (9.9 dtex) or less.

The fibers of this invention are monocomponent fibers. (Thus, specifically excluded are bicomponent and multicomponent fibers, such as sheath core or side-by-side fibers made of two different types of polymers or two of the same polymer having different characteristics in each region, but does not exclude other polymers being dispersed in the fiber and additives being present.) They can be solid, hollow or multi-hollow.

Preferably the staple fibers of this invention are used to make apparel, nonwoven fabrics and fiberfill, most preferably apparel such as knitted and woven fabrics. Apparel (e.g., yarns) and nonwoven fabrics can be prepared by opening the bales, carding the staple fibers and then blending them. More specifically, in making, nonvovens the fibers are bonded using conventional techniques (e.g., thermal bonding, needelepunching, spunlacing, etc.). In making knitted and woven fabrics, the fibers are sliver-drawn and spun into yarn, again using conventional techniques. Then, the yarn is knitted or woven into fabric. They fibers of this invention can be blended with other types of fibers such as cotton, 2GT, nylon, lyocel, acrylic, polybutylene terephthalate, etc. In addition, they may be blended with 3GT fibers having other shapes, or with other types of fibers, including continuous filaments.

The staple fibers of this invention can be used in fiberfill applications. Preferably, the bales are opened, the fibers are combed—garnetted or carded—to form a web, the web is cross-lapped to form a batt (this enables achieving a higher weight and or size), and the batts are filled into the final product using a pillow stuffer or other filler device. The fibers in the web can be further bonded together using common bonding techniques, such as spray (resin) bonding, thermal bonding (low-melt) and ultrasonic bonding. A low bonding temperature staple fiber (e.g., low bonding temperature polyester) is optionally mixed with the fibers to enhance bonding.

Fiberfill webs produced with the claimed invention are typically about 0.5—about 2 ounces/yard$^2$ (about 17—about 68 g/m$^2$). Cross-lapped batts can comprise about 30—about 1,000 g/m$^2$ of fiber.

Using the invention, it is possible to prepare polytrimethylene terephthalate fiberfill having properties superior to 2GT staple fiberfill, including but not limited to increased fiber softness, crush resistance, self-bulking, and superior moisture transport properties.

Fiberfill prepared according to this invention can be used in many applications. including apparel (e.g., bra padding), pillows, furniture, insulation, comforters. filters, automotive (e.g., cushions), sleeping bags, mattress pads and mattresses.

EXAMPLES

The following examples are presented for the purpose of illustrating the invention, and are not intended to be limiting. All parts, percentages, etc., are by weight unless otherwise indicated.

Measurements and Units

Measurements discussed herein were made using conventional U.S. textile units, including denier, which is a metric unit. To meet prescriptive practices elsewhere, the U.S. units are reported herein, together with the corresponding metric units. For example, the dtex equivalents for denier are provided in parentheses after the actual measured values.

Specific properties of the fibers were measured as described below.

Relative Viscosity

Relative Viscosity ("LRV") is the viscosity of polymer dissolved in HFIP solvent (hexafluoroisopropanol containing 100 ppm of 98% reagent grade sulfuric acid). The viscosity measuring apparatus is a capillary viscometer obtainable from a number of commercial vendors (Design Scientific, Cannon, etc.). The relative viscosity in centistokes is measured on a 4.75 wt. % solution of polymer in HFIP at 25° C. as compared with the viscosity of pure HFIP at 25° C.

Intrinsic Viscosity

The intrinsic viscosity (IV) was determined using viscosity measured with a Viscotek Forced Flow Viscometer Y900 (Viscotek Corporation, Houston, Tex.) for the polyester dissolved in 50/50 weight % trifluoroacetic acid/methylene chloride at a 0.4 grams/dL concentration at 19° C. following an automated method based on ASTM D 5225-92.

Wicking

The wicking rates of the fabrics in the Example were measured by vertically immersing the bottom 1.8 inches (4.6 cm) of a one inch (2.5 cm) wide strip of the fabric in de-ionized water, visually determining the height of the water wicked up the fabric, and recording the height as a function of time.

Crimp Take-Up

One measure of a fiber's resilience is crimp take-up ("CTU") which measures how well the indicated frequency and amplitude of the secondary crimp is set in the fiber. Crimp take-up relates the length of the crimped fiber to the length of the extended fiber and thus it is influenced by crimp amplitude, crimp frequency, and the ability of the crimps to resist deformation. Crimp take-up is calculated from the formula:

$$CTU(\%)=[100(L_1-L_2)]/L_1$$

wherein $L_1$ represents the extended length (fibers hanging under an added load of 0.13±0.02 grams per denier (0.115±0.018 dN/tex) for a period of 30 seconds) and $L_2$ represents the crimped length (length of the same fibers hanging under no added weight after resting for 60 seconds following the first extension).

Example 1

This example illustrates the advantages of the staple fibers of the present invention in textile applications such as yam and fabrics. In this example, poly(trimethylene terephthalate) fibers having a tetrachannel cross section, shown in FIG. 1, were spun from flake, using a conventional melt extruder at a spinning block temperature of 265° C. The fibers were extruded at a rate of about 70 pph (31.75 kg/h), using a spinneret with 1054 capillaries, and a spinning speed of 2066 ypm (1889 mpm). The spun fibers were then drawn, using conventional polyester staple drawing equipment, using two sets of parameters, yielding Drawn Yarns A and B, as described below.

Drawn Yam A

Poly(trimethylene terephthalate) fibers were drawn using a bath temperature of 75° C. and a draw speed of about 50 ypm (46 mpm), with a total draw ratio of 1.8 times.

Drawn Yam B

Poly(trimethylene terephthalate) fibers were drawn in a similar manner, however, the bath temperature was 85° C. and the draw speed was about 100 ypm (91 mpm), with a total draw ratio of 2.0 times.

Crimped Fibers A and B

The fibers of Drawn Yarns A and B were then crimped in a conventional manner with the assistance of steam at 15 psig (103 kN/m$^2$) manifold pressure, to about 12 cpi (30 c/cm). The fibers were then relaxed in tow form according to the present invention for about 8 minutes, at 100° C. The fibers were then cut to 1.5 inches long staple, using conventional staple cutting equipment. The physical properties of these fibers are shown in Table 1.

TABLE 1

Crimped Fiber Properties

| Description | Fiber A | Fiber B |
|---|---|---|
| Draw Speed (ypm)(mpm) | 50 (46) | 100 (91) |
| Draw Ratio | 1.8 | 2.0 |
| Draw Bath Temperature (° C.) | 75 | 85 |
| Crimper Steam Pressure (psig)(kN/m$^2$) | 15 (103) | 15 (103) |
| Relaxation Temperature (° C.) | 100 | 100 |
| Relaxer Residence (min.) | 8 | 8 |
| Denier Per Filament (dpf)(g/dtex) | 2.0 (2.2) | 1.8 (2) |
| Modulus (g/d)(g/dtex) | 13 (11.7) | 15 (13.5) |
| Tenacity (g/d)(g/dtex) | 2.8 (2.5) | 3.2 (2.8) |
| Elongation (%) | 54 | 48 |
| Crimp Take-Up (%) | 39 | 31 |

Spun Yarns A and B

Figure 2:
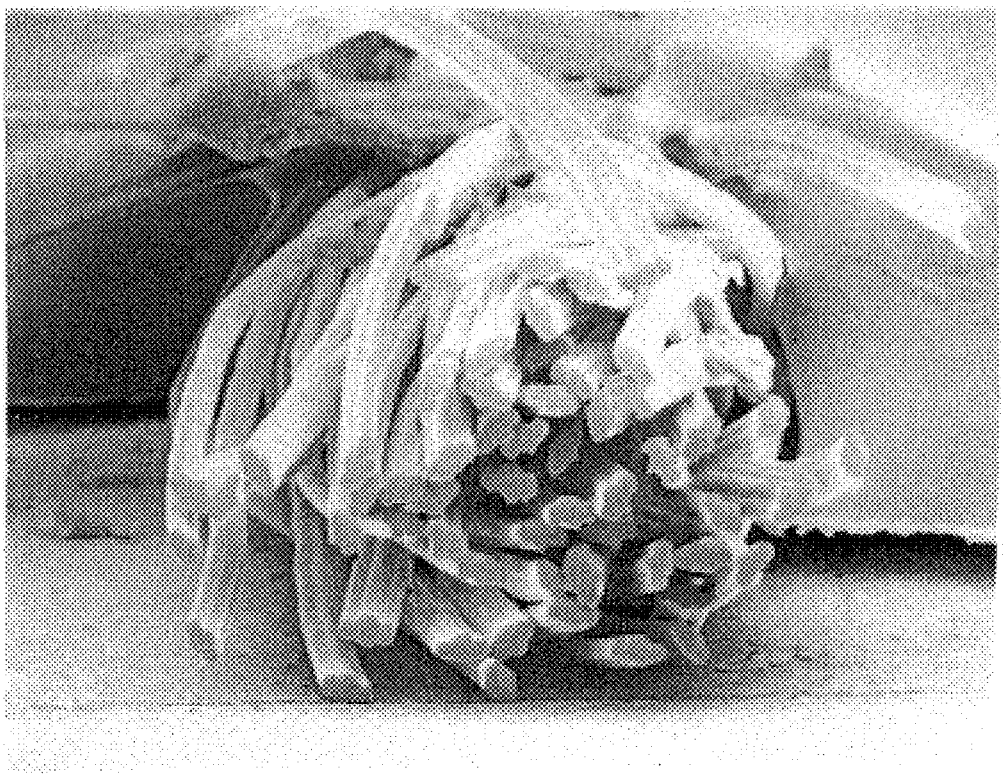
FIG. 2 is a magnified photograph showing the cross-sectional configuration of Spun Yarn A, made from poly (trimethylene terephthalate) fibers according to the method of the present invention.
Figure 3:
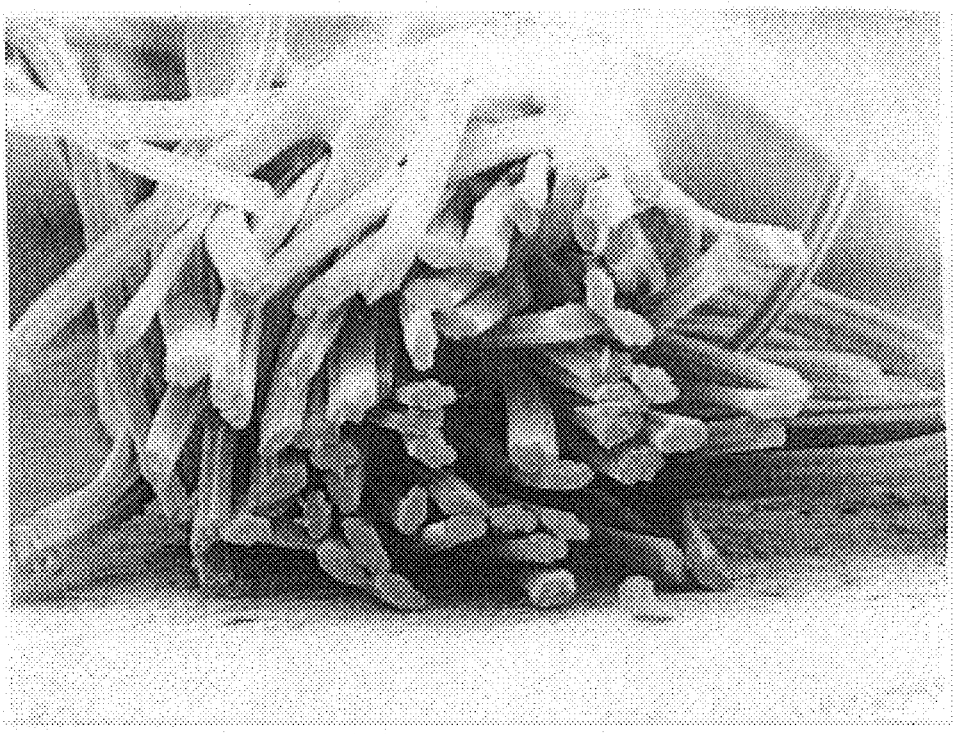
FIG. 3 is a magnified photograph showing the cross-sectional configuration of Spun Yarn B, made from poly (trimethylene terephthalate) fibers according to the method of the present invention.

Fibers A and B were converted into spun yarns trade count of thirty singles (i.e. Ne 30) via ring spinning, in a conventional manner. (Ne30 refers to the number of 840 yard (768 meter) lengths of yam required to weigh 1 pound (0.454 kg)). Magnified photographs showing the cross section of Spun Yam A and Spun Yarn B, are shown in FIG. 2 and FIG. 3, respectively. Knitted fabric was made from each of the yarns and measured for various properties desirable in the textile industry.

(Comparative) Spun Yam C

Figure 4:
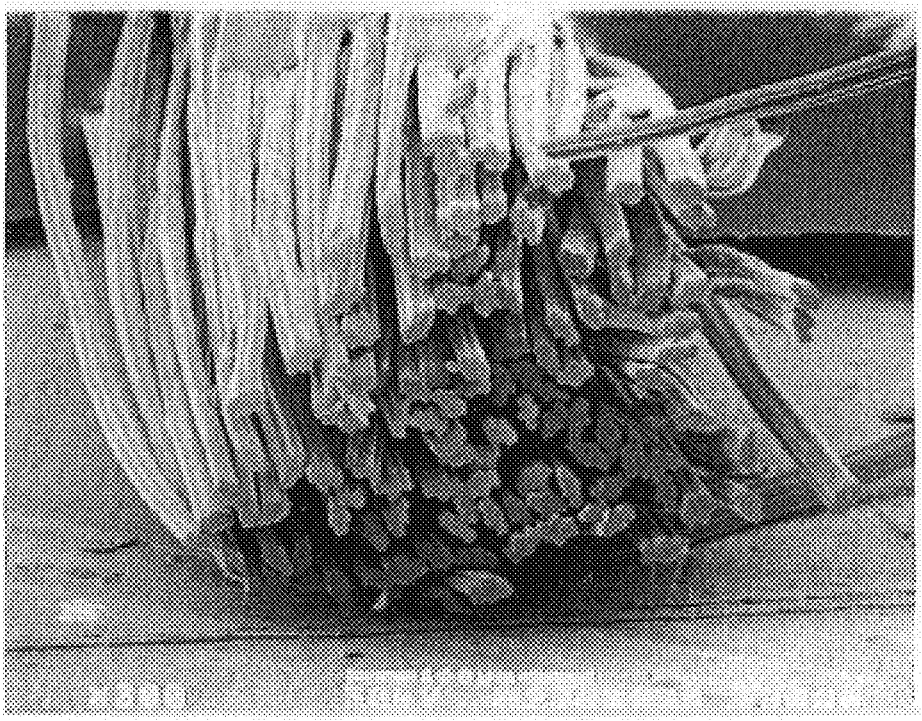
FIG. 4 is a magnified photograph showing the cross-sectional configuration of Spun Yarn C, made from polyethylene terephthalate fibers according to conventional methods.

Commercially available 1.5 inch (3.81 cm) cut staple fibers from 2GT fibers of similar cross section were also spun, using the ring spinning method, into Ne 30 spun yarns. These yarns, Spun Yam C, were used as a control sample. A magnified photograph showing the cross section of Spun Yam C is shown in FIG. 4.

The yarns A, B, and C were knitted into fabrics and tested for pilling and wicking performance. As described below, the fabrics made from the yarns of the present invention exhibit as good or better performance over fabric knitted using conventional 2GT yarns.

Pilling Performance

Spun Yarns A, B and C were knitted into sleeves, then dyed and checked for pilling performance using Random Tumble Pill Test (ASTM D-3512 (modified in that the edges were not glued)), all using conventional technology. The fabrics were tested using both boil dyeing and pressure dyeing. Table 3 lists the test results for each fabric tested. The results of the first test are shown for three points in time (30, 60 and 90 minutes). The values reported are based on a scale of 1 to 5, with 5 being the best, 1 being the lowest pilling performance. Fabrics knitted from Yarn A performed better when dyed at boil than both fabrics from Yarns B and C. However, fabric from Yam B performed better than the other two when pressure dyed. Thus, overall, fabrics from Yarns A and B were better than the fabric from Yam C.

Also shown in Table 3 are the results of the dye-uptake test. The fabrics knitted with Spun Yarns A and B experienced dye uptake well above 300% while the fabric knitted from Spun Yarn C had a dye uptake of only 100%.

TABLE 3

Knitted Fabric Performance

| Description | Yarn | Pilling 30 min. | Pilling 60 min. | Pilling 120 min. | Dyeing Dye Uptake | Polymer LRV |
|---|---|---|---|---|---|---|
| Dyed at Boil | A | 3.0 | 2.5 | 1.0 | 312% | 34 |
| | B | 2.0 | 1.0 | 1.0 | 315% | 34 |
| | C | 2.0 | 1.0 | 1.0 | 100% | 19.6 |

TABLE 3-continued

| Description | Yarn | Knitted Fabric Performance Pilling 30 min. | Pilling 60 min. | Pilling 120 min. | Dyeing Dye Uptake | Polymer LRV |
|---|---|---|---|---|---|---|
| Pressure Dye | A | 2.0 | 1.0 | 1.0 | 395% | 34 |
| | B | 3.0 | 2.0 | 1.0 | 319% | 34 |
| | C | 2.0 | 1.0 | 1.0 | 100% | 19.6 |

Another difference noted with fabrics made from yarns of the present invention is the unexpected improvement in pilling performance, despite the increased LRV. Conventional yarns exhibit the opposite effect, i.e., reducing the LRV for 2GT polymer generally results in better pilling performance. In contrast, the Polymer LRV for fabrics made using Spun Yarns A and B was over 50% greater than the fabrics made from conventional yarns, Spun Yam C, yet Spun Yarns A and B had 200% better pilling performance.

Wicking Performance

The knitted fabrics were then evaluated for moisture wicking. This was achieved by measuring the wicking height as a function of time.

TABLE 4

Wicking Performance
Height in inches (cm) at Time Indicated)

| Yarn | Sample | 5 min. | 10 min. | 30 min. |
|---|---|---|---|---|
| A | 1 | 2.8 (7.1) | 4.1 (10.4) | 5.0 (12.7) |
| | 2 | 2.1 (5.3) | 2.9 (7.4) | 4.6 (11.7) |
| B | 1 | 2.9 (7.4) | 4.3 (10.9) | 5.0 (12.7) |
| | 2 | 3.0 (7.6) | 4.2 (10.7) | 5.0 (12.7) |
| C | 1 | 0.8 (2.0) | 1.2 (3.0) | 3.1 (7.9) |
| | 2 | 1.4 (3.6) | 1.8 (4.6) | 3.0 (7.6) |

As shown in Table 4, the fabrics knitted from Spun Yarns A and B exhibited superior wicking performance when compared to the fabrics knitted from Spun Yarn C.

Example 2

In this example, poly(trimethylene terephthalate) fibers having a tetrachannel cross section were spun from flake, using a conventional melt extruder at a spinning block temperature of 265° C. The fibers were extruded at a rate of about 70 pph (31.75 kg/h), using a spinneret with 1054 capillaries, and a spinning speed similar to Example 1. The spun fibers were then drawn, using conventional polyester staple drawing equipment yielding the yarn described below.

TABLE 5

| |
|---|
| Draw Ratio 1.5 |
| Draw bath temperature 85° C. |
| Relaxation Temperature = 100° C. |
| (8 minutes residence time) |
| Staple dpf = 1.5 |
| Crimper steam pressure = 14 psig |
| Modulus = 16.5 g/denier |
| Tenacity 3.1 g/denier (2.74 cN/dtex) |
| Elongation = 64.3% |
| Crimp Take Up = 26% |

The wicking performance was then measured, with results given in Table 6.

TABLE 6

Wicking Performance
Wicking Height, inches (cm) at time indicated

| Sample | 5 min. | 10 min. | 30 min. |
|---|---|---|---|
| Test 1 | 3.1 (7.9) | 3.7 (9.4) | 5.0 (12.7) |
| Test 2 | 3.0 (7.6) | 3.6 (9.1) | 5.0 (12.7) |

This table again shows the excellent wicking performance of 3GT tetrachannel staple fibers.

Example 3

This example demonstrates the preferred embodiment of the invention for a staple fiber with a scalloped oval cross section prepared under a series of processing conditions.

Polytrimethylene terepthalate of intrinsic viscosity (IV= 1.04) was dried over an inert gas heated to 175° C. and then melt spun into an undrawn staple tow through 1054 hole spinnerettes designed to impart a scalloped oval cross section. The spin block and transfer line temperatures were maintained at 254° C. At the exit of the spinnerette. the threadline was quenched via conventional cross flow air. A spin finish was applied to the quenched tow and it was wound up at 1500 yards/min (1370 meters/minute). The undrawn tow collected at this stage was determined to be 2.44 dpf (2.68 dtex) with a 165% elongation to break and having a tenacity of 2.13 g/denier (1.88 cN/dtex). The tow product described above was drawn, optionally annealed, crimped, and relaxed under a series of conditions which are all examples of the preferred embodiment of the invention.

Example 3A

This example processes the tow using a two stage draw-relax procedure. The tow product was drawn via a two stage draw process with the total draw ratio between the first and the last rolls set to 1.97. In this two stage process, between 80–90% of the total draw was done at room temperature in the first stage, and then the remaining 10–20% of the draw was done while the fiber was immersed in an atmospheric steam chamber set to 90–100° C. The tension of the tow line was continually maintained as the tow was fed into a conventional stuffer box crimper. Atmospheric steam was also applied to the tow band during the crimping, process. After crimping, the tow band was relaxed in a conveyer oven heated to 60° C. with a residence time in the oven of 6 minutes. The resulting tow was cut to a staple fiber which had a dpf of 1.68 (1.85 dtex). While the draw ratio was set to 1.97 as described above, the reduction in denier from undrawn tow (2.44 dpf) to final staple form (1.68 dpf) suggests a true process draw ratio of 1.45. The difference is caused by shrinkage and relaxation of the fiber during the crimping and relaxer steps. The elongation to break of the staple material was 68% and the fiber tenacity was 3.32 g/denier (2.93 cN/dtex). The crimp take-up of the fiber was 29% with a crimp/inch of 14 (5.5 crimp/cm).

Example 3B

This example processes the tow using a two stage draw-anneal-relax procedure. In this example the fiber is processed similar to example 3A with the exception that in the second stage of the draw process the atmospheric steam was replaced by a water spray heated to 65° C., and the tow was annealed under tension at 105° C. over a series of heated rolls before entering the crimping stage. The resulting staple fiber was determined to be 1.65 dpf (1.82 dtex). with in elongation to break of 66%, and the fiber tenacity was 3.34 g/denier (2.95 cN/dtex). The crimp take-up of the fiber was 30% with a crimp/inch of 13 (5.1 crimp/cm).

Example 3C

This example processes the tow using a two stage draw-anneal-relax procedure. In this example the fiber is processed similar to example 3B with the exception that the total draw ratio between the first and last rolls was set to 2.40, the anneal rolls were heated to 95° C., and the relaxer oven was set to 70° C. The resulting staple fiber was determined to be 1.47 dpf (1.62 dtex), with an elongation to break of 56%, and the fiber tenacity was 3.90 g/denier (3.44 cN/dtex). The crimp take-up of the fiber was 28.5% with a crimp/inch of 14 (5.5 crimp/cm).

Conversion of the Fibers of Example 3C to Staple Spun Yarns

In Table 7. the physical properties of the fibers of example 3 are compared to a commercial Dacron® T-729W scalloped oval cross section fiber made from polyethylene terephthalate (E. I. du Pont de Nemours and Company, Wilmington, Del.).

TABLE 7

| Fiber Type | Denier per Filament | Elongation to Break (%) | Fiber Tenacity (gpd) | T10 (Tenacity at 10% Elongation) |
|---|---|---|---|---|
| Example 3C | 1.47 | 60.5 | 3.87 | 0.98 |
| Dacron T-729W | 1.57 | 56.1 | 3.90 | 0.81 |

The staple fibers of example 3C were cut to 1.5" and processed into staple spun yarns via the conventional process of carding, drawing, roving, and ring spinning into a nominal cotton count of 22/1 (241.6 denier) yarns. Yarns produced are described here, and are summarized in Table 8.

Yarn

E Dacron T-729W

F 50% Example 3C, 50% Dacron T-729W

G 50% Example 3C, 50% Cotton

H 50% Example 3C, 50% 1.5 denier Lyocell

I 50% Example 3C, 50% 1.2 denier Acrylic staple

J Example 3C

The tensile properties (elongation to break, breaking strength, and tenacity) were determined using a Tensojet (Zellweger Uster Corp.) and each of these properties represented in Table 8 below is the average of 2500 measurements. The yarn CV (average coefficient of mass variation along the yarn length) was determined using a Uniformity 1-B Tester (Zellweger Uster Corp.)

TABLE 8

| Property | E | F | G | H | I | J |
|---|---|---|---|---|---|---|
| Yarn CV% | 11.55 | 12.10 | 17.66 | 11.15 | 12.52 | 14.18 |
| Yarn Count (CC) | 23.01 | 22.48 | 20.43 | 19.31 | 24.28 | 22.78 |
| Twist (turns/meter) | 695 | 715 | 693 | 708 | 708 | 712 |

TABLE 8-continued

| Property | E | F | G | H | I | J |
|---|---|---|---|---|---|---|
| Elongation to Break | 22.5 | 27.2 | 5.6 | 9.2 | 24.0 | 34.8 |
| Breaking Strength (cN) | 168.9 | 157.5 | 78.9 | 139.7 | 115.0 | 132.1 |
| Tenacity (cN/tex) | 21.2 | 19.9 | 10.7 | 23.2 | 17.3 | 19.2 |

Surprisingly, the spun yarns made according to the present invention have superior elongation over yarns made from 2GT. This is illustrated by comparison of the elongation values for the fiber (Table 7) versus that of the yarn (Table 8). It is unexpected that a 55% increase in elongation of the yarns made from staple fibers of the invention could be obtained when the elongation of the free staple fibers is within 10% of the 2GT fibers.

The spun yarns listed above were knitted into fabrics and tested for pill resistance in a manner similar to example 1. With a rating of 1 equal to severe pilling and 5 equal to a non pilled surface.

TABLE 9

| Pill Testing | E | F | G | H | I | J |
|---|---|---|---|---|---|---|
| 10 min | 3.5 | 4.0 | 3.0 | 4.0 | 4.0 | 4.0 |
| 20 min | 2.5 | 4.0 | 2.5 | 3.0 | 3.5 | 3.0 |
| 40 min | 1.0 | 2.0 | 2.0 | 2.5 | 1.0 | 3.5 |

A surprising result is the improved pilling performance of item J of the invention relative to 2GT E. Further of surprising interest is the increase in pill rating for the 40 min tumbling time versus the 20 minute time for item J of the invention. This is consistent with the unique property of the fiber of the invention in that it shows a reduced tendency to form tight, and tenaciously-held pills, as is typical of 2GT fibers, such as item E.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

We claim:

1. A fabric, characterized by a wicking height of at least 2 inches after 5 minutes, consisting essentially of yam consisting essentially of 0.8–3 dpf monocomponent poly (trimethylene terephthalate) staple fiber having a tetrachannel cross-section, a length of 0.2–6 inches, and a tenacity of 3.0 to 6.5 grams/denier.

2. The fabric of claim 1 wherein the tetrachannel cross section further comprises a scalloped-oval shape with grooves.

3. The fabric of claim 1 characterized by a dye uptake of at least 300%.

4. The fabric of claim 2 characterized by a dye uptake of at least 300%.

5. The fabric of claim 1 characterized by a wicking height of at least 4 inches after 10 minutes.

6. The fabric of claim 4 characterized by a wicking height of at least 5 inches after 30 minutes.

7. The fabric of claim 1 characterized by a wicking height of at least 4 inches after 10 minutes.

8. The fabric of claim 7 characterized by a dye uptake of at least 300%.

9. The fabric of claim 1 wherein the length is 0.5–3 inches.

10. The fabric of claim 2 wherein the length is 0.5–3 inches.

11. The fabric of claim 2 wherein the tenacity is 3.0–5 grams/denier.

12. The fabric of claim 2 wherein the tenacity is 3.5–6.5 grams/denier.

13. The fabric of claim 1 wherein the staples fibers are 1–2.5 dpf.

14. The fabric of claim 11 wherein the staples fibers are 1–2.5 dpf and the length is 0.5–3 inches.

15. The fabric of claim 10 wherein the staples fibers are 1.2–2 dpf.

16. The fabric of claim 1 wherein the staples fibers contain at least 85 weight % polytrimethylene terephthalate polymer.

17. The fabric of claim 2 wherein the staples fibers contain at least 90 weight % polytrimethylene terephthalate polymer.

18. The fabric of claim 4 wherein the staples fibers contain at least 85 weight % polytrimethylene terephthalate polymer, the staples fibers are 1–2.5 dpf and the length is 0.5–3 inches.

19. The fabric of claim 1 which is a knitted fabric.

20. The fabric of claim 2 which is a knitted fabric.

21. The fabric of claim 4 which is a knitted fabric.

22. The fabric of claim 10 which is a knitted fabric.

23. The fabric of claim 18 which is a knitted fabric.

24. The fabric of claim 18 which is a knitted fabric.

25. The fabric of claim 1 which is a woven fabric.

26. The fabric of claim 18 which is a woven fabric.

* * * * *

UNITED STATES PATENT AND TRADEMARK OFFICE

CERTIFICATE OF CORRECTION

PATENT NO. : 6,458,455 B1
DATED : October 01, 2002
INVENTOR(S) : Hernandez Ismael A. et al.

It is certified that error appears in the above-identified patent and that said Letters Patent is hereby corrected as shown below:

Column 14,
Line 66, reaplace “claim 1” with -- claim 2 --

Column 15,
Line 13, replace “claim 11” with -- claim 4 --

Column 16,
Line 12, replace “claim 18” with -- claim 16 --

Signed and Sealed this

Thirteenth Day of July, 2004

JON W. DUDAS
*Acting Director of the United States Patent and Trademark Office*